US006264886B1

(12) United States Patent
Mizuta et al.

(10) Patent No.: US 6,264,886 B1
(45) Date of Patent: Jul. 24, 2001

(54) SINTERED METALLIC ALLOY, METHOD OF MANUFACTURING THE SINTERED METALLIC ALLOY, AND SINTERED ALLOY GEAR EMPLOYING THE SINTERED METALLIC ALLOY

(75) Inventors: Muneo Mizuta; Yasushi Yabe; Yoshihisa Tomihari, all of Fuji (JP)

(73) Assignee: JATCO Corporation, Fuji (JP)

( * ) Notice: Subject to any disclaimer, the term of this patent is extended or adjusted under 35 U.S.C. 154(b) by 0 days.

(21) Appl. No.: 09/175,971

(22) Filed: Oct. 21, 1998

(30) Foreign Application Priority Data

Oct. 21, 1997 (JP) ..... 9-325122

(51) Int. Cl.[7] ..... B22F 3/24
(52) U.S. Cl. ..... 419/25; 419/26; 148/586
(58) Field of Search ..... 419/25, 26, 28, 419/29; 148/589

(56) References Cited

U.S. PATENT DOCUMENTS 4,614,544 * 9/1986 Lall ..... 75/246
4,614,638 * 9/1986 Kuroishi et al. ..... 419/39
5,552,109 * 9/1996 Shivanath et al. ..... 419/53
5,562,786 * 10/1996 Hayashi et al. ..... 148/579
5,682,588 * 10/1997 Tsutsui et al. ..... 419/11

FOREIGN PATENT DOCUMENTS 58-19412 2/1983 (JP) .

* cited by examiner

*Primary Examiner*—Ngoclan Mai
(74) *Attorney, Agent, or Firm*—Jacobson, Price, Holman & Stern, PLLC

(57) ABSTRACT

There is provided a sintered metallic alloy having toughness capable of supporting stress at a point by distributing structure portions having different values of rigidity approximately uniformly without separation of layers different in brashiness. A method of manufacturing the sintered metallic alloy and a sintered alloy gear employing the sintered metallic alloy are also provided. Metallic materials are formed into a predetermined configuration. Then, the metallic materials is sintered in a sintering furnace (14) to make a sintered metallic alloy. Next, the sintered metallic alloy is cooled gradually to an ambient atmosphere of room temperature. Finally, the temperature of the cooled metallic alloy is raised and a toughness stabilizing process is performed in a low-temperature furnace (18) so that structures with high toughness are distributed approximately uniformly.

11 Claims, 15 Drawing Sheets

(2 of 15 Drawing Sheet(s) Filed in Color)

ROCKWELL HARDNESS

MICROSCOPIC HARDNESS BY STRUCTURES 15
16
16b
17
1
1a
1b
18
18a
14
14a
14b
SINTERING / GRADUAL COOLING
TOUGHNESS STABILIZING PROCESS
SIZING
INSPECTION
FINISHED PRODUCT
POSTPROCESSING 12
15
12a
13
12b

11

MATERIALS
MIXING
COMPACTING 14
14a
14b
15
16
16b
17
18
18a
1
1a
1b
SINTERING / GRADUAL COOLING
SIZING
TOUGHNESS STABILIZING PROCESS
INSPECTION
FINISHED PRODUCT
POSTPROCESSING 11
12
12a
12b
13
14
15
15
MATERIALS
MIXING
COMPACTING
SINTERING

Table 1

FIG. 13

| MEASUREMENT CONTENTS | ELEMENT NAMES | MEASUREMENT CONDITIONS | | MEASUREMENT RESULTS/UNIT (mm) | | |
|---|---|---|---|---|---|---|
| | | NUMBER OF MEASURED POINTS | MEASURED SITES | INITIAL VALUES | AFTER TOUGHNESS STABILIZING PROCESS | |
| | | | | MEASURED VALUES A | MEASURED VALUES B | DIFFERENCES C = B − A |
| G/INT B.B.D. DIMENSION (G/INT TOOTH SURFACE) SPHERICAL DIAMETER =φ1.5 | G-CIR(1) | 4 | -1.5mm FROM G/INT END LAND (DIAMETER OF A CIRCLE CONSISTING OF 4 CENTERS OF GRAVITY, G. POIs(1) TO (4)) | 71.431( 4) | 71.426( 6) | -0.005(+2) |
| | G-CIR(2) | 4 | -5.5mm FROM G/INT END LAND (DIAMETER OF A CIRCLE CONSISTING OF 4 CENTERS OF GRAVITY, G. POIs(5) TO (8)) | 71.435( 3) | 71.430( 6) | -0.005(+3) |
| | G-CIR(3) | 4 | -8mm FROM G/INT END LAND (DIAMETER OF A CIRCLE CONSISTING OF 4 CENTERS OF GRAVITY, G. POIs(9) TO (12)) | 71.425( 5) | 71.420( 4) | -0.005(-1) |
| | G-CIR(4) | 4 | -13mm FROM G/INT END LAND (DIAMETER OF A CIRCLE CONSISTING OF 4 CENTERS OF GRAVITY, G. POIs(13) TO (16)) | 71.424( 3) | 71.415( 3) | -0.009( 0) |
| G/INT OUTSIDE DIAMETER | GAIKE(1) | 12 | -1mm FROM END SURFACE | 77.272( 3) | 77.269( 9) | -0.003(+6) |
| | GAIKE(2) | 12 | -3mm FROM END SURFACE | 77.284( 3) | 77.281( 7) | -0.003(+4) |
| | GAIKE(3) | 12 | -5.5mm FROM END SURFACE | 77.298( 3) | 77.294( 6) | -0.004(+3) |
| | GAIKE(4) | 12 | -8mm FROM END SURFACE | 77.312( 3) | 77.307( 6) | -0.005(+3) |
| | GAIKE(5) | 12 | -10mm FROM END SURFACE | 77.322( 4) | 77.317( 6) | -0.005(+2) |
| | GAIKE(7) | 12 | -12mm FROM END SURFACE | 77.334( 4) | 77.329( 5) | -0.005(+1) |
| | GAIKE(8) | 12 | -16mm FROM END SURFACE (CLOSER TO B-SURFACE) | NONE | 77.356( 5) | NONE |
| FLATNESS OF B-SURFACE | PLA(1) | 8 | INSIDE DIAMETER PROXIMITY(φ46) | 0.005 | 0.006 | +0.001 |
| | PLA(2) | 8 | (φ57) | 0.004 | 0.003 | -0.001 |
| | PLA(3) | 8 | COMBINATION OF PLA(1) AND PLA(2) | 0.008 | 0.009 | +0.001 |
| SPLINE B.B.D. DIMENSION SPHERICAL DIAMETER=φ2 (DRAWING φ1.75) | S-DAN(11) | 18 | Z=-18mm (CLOSER TO B-SURFACE), SELF-CENTERING OF ALL 18 TEETH | 19.749(19) | 19.748(17) | -0.001(-2) |
| | S-DAN(12) | 18 | Z=-20mm | 19.729(18) | 19.727(17) | -0.002(-1) |
| | S-DAN(13) | 18 | Z=-22mm | 19.729(16) | 19.726(15) | -0.003(-1) |
| | S-DAN(14) | 18 | Z=-24mm | 19.733(17) | 19.729(16) | -0.004(-1) |
| | S-DAN(15) | 18 | Z=-26mm | 19.745(13) | 19.740(14) | -0.005(+1) |
| | S-DAN(16) | 18 | Z=-28mm | 19.753( 9) | 19.748(17) | -0.005(+8) |
| | S-DAN(17) | 18 | Z=-30mm | 19.756(13) | 19.751(21) | -0.005(+8) |
| | S-DAN(18) | 18 | Z=-31mm | 19.755(15) | 19.751(24) | -0.004(+9) |

SINTERED METALLIC ALLOY, METHOD OF MANUFACTURING THE SINTERED METALLIC ALLOY, AND SINTERED ALLOY GEAR EMPLOYING THE SINTERED METALLIC ALLOY

BACKGROUND OF THE INVENTION

1. Field of the Invention

The present invention relates to a sintered metallic alloy suitable for an internal gear such as a planetary gear, a method of manufacturing the sintered metallic alloy, and a sintered alloy gear employing the sintered metallic alloy.

2. Description of the Related Art

Regarding such a kind of conventional sintered metallic alloy, a method of manufacturing the sintered metallic alloy, and a sintered alloy gear employing the sintered metallic alloy, a sintered metallic gear manufactured, for example, through manufacturing steps such as those shown in FIG. 12(*a*) through FIG. 12(*g*) is known.

That is, metallic materials, such as iron powder, any other metal powder, and a lubricant, for sintered metallic parts such as a sintered internal gear 10, such as those shown in FIG. 12(*a*), are blended and mixed at a predetermined ratio by a mixer 11, as shown in FIG. 12(*b*). As shown in FIG. 12(*c*), a predetermined weight of the mixed metallic materials is poured into a metal mold 12.

Then, an upper punch 12*a* and a lower punch 12*b* of the metal mold 12 are slid to move toward each other along the core rod 13, and a pressure of 3 to 7 tonf/cm$^2$ is applied to the mixed metallic materials from directions above and below, whereby compression molding is performed.

Next, as shown in FIG. 12(*d*), the compression molded compacts 15 are heated in a sintering furnace 14 for a predetermined time at a high temperature less than the melting point, whereby the diffusion bonding of metal particles in the compacts 15 is promoted to solidify them.

In order to further enhance the quality and characteristics and obtain finished products corresponding to various purposes or uses, after-treatment is performed.

Subsequently, as shown in FIG. 12(*e*), in order to obtain the sintered internal gear 10, the solidified compact 15 is put into a sizing metal mold 16. An upper punch 16*a* and a lower punch 16*b* of this sizing metal mold 16 are slid to move toward each other along the core rod 17, and a pressure is applied to the compact 15 again from directions above and below. By that, sizing is performed.

After sizing, inspection is performed as shown in FIG. 12(*f*), and a sintered metallic part such as the sintered internal gear 10 is obtained as a finished product (FIG. 12(*g*)).

An after-treatment technique related to the aforementioned after-treatment is disclosed in Japanese Laid-Open Patent Publication No. SHO 58-19412 (19412/83). The disclosed after-treatment technique is as follows. That is, after sintering in a sintering furnace, quenching is performed at a re-raised temperature of 860° C., and thereafter, tempering is performed at about 180° C., whereby the resistance of the sintered alloy gear to high surface pressure is enhanced.

However, in the sintered alloy gear constructed in the aforementioned manner, the structure in a range of 0.02 to 0.3 mm from the exterior surface toward the inside consists of an austenite layer having conformability, so that due to quenching and subsequent tempering, a thin austenite layer containing austenite entirely different in toughness in high density is formed on the surface of an inner martensite layer containing martensite having high brashiness in high density, and therefore, the inner and outer structures of the sintered alloy gear are separated from each other.

For this reason, the surface of the internal gear including relatively narrow area of contacting surface portion, which high pressure is applied to, is constituted by the aforementioned martensite layer. As a result, toughness is insufficient at microscopic portions and it is difficult to support stress load at a point.

SUMMARY OF THE INVENTION

It is an object of the present invention to provide a sintered metallic alloy having toughness capable of supporting stress load at a point by constructing its structure so that each portion having different rigidity is distributed approximately uniformly without separation of layers different in toughness.

Another object of the present invention is to provide a method of manufacturing the aforementioned sintered metallic alloy.

Still another object of the present invention is to provide a sintered alloy gear employing the aforementioned sintered metallic alloy.

To achieve the aforementioned objects of the present invention and in accordance with one aspect of the invention, there is provided a sintered metallic alloy wherein structure portions with high toughness are distributed approximately uniformly from a surface thereof toward the inside thereof.

In the sintered metallic alloy constructed as described above, structure portions with high toughness are distributed approximately uniformly without separation of layers different in rigidity, so that stress load exerted at a point is supported by the entire surface. For this reason, there is no possibility that a portion of the sintered metallic alloy will cave in due to concentration of stress, and the stress between members with a small contacting area can be supported.

In accordance with another aspect of the present invention, there is provided a method of manufacturing a sintered metallic alloy, wherein a sintered metallic alloy, which is cooled to about an ambient atmosphere of a room temperature by being cooled slowly after being sintered in a form of a predetermined shape of metallic materials for sintering in a sintering furnace, is heated up as a toughness stabilizing process so that structure portions with high toughness are distributed approximately uniformly.

In the aforementioned manufacturing method, the metallic materials for sintering, which is formed in a predetermined shape, is cooled to about an ambient atmosphere of a room temperature by being cooled slowly after being sintered in the sintering furnace. Then, the structure portions in the sintered metallic alloy having high toughness are distributed approximately uniformly mainly owe to the changes of the high-rigidity structure portions to structure portions having high toughness with holding rigidity by re-raising of temperature of the sintered metallic alloy to the predetermined temperature. As a result, the structure portions having respective rigidities are distributed approximately uniformly, whereby the toughness is enhanced in the form of a surface.

In accordance with still another aspect of the present invention, there is provided a sintered alloy gear employing a sintered metallic alloy, wherein a generally disk-shaped flange portion provided with a boss portion at its center is formed integrally on one end face of a main body of an internal gear provided with a gear surface arranged almost in a shape of a circle at its interior surface.

In the sintered alloy gear constructed as described above, though the generally disk-shaped flange with a boss portion at the approximate center thereof is formed integrally on one end face of the internal gear main body forming a general ring shape and comprising its gear surface at the interior surface portion, stress due to molding can be reduced and flower blooming after cooling can be suppressed, because structure portions having different values of rigidity are distributed approximately uniformly without separation of layers different in rigidity. For this reason, dimensional accuracy can be enhanced.

In the aforementioned manufacturing method, sizing may be performed before the toughness stabilizing process is performed. In this case, sizing is performed before the toughness stabilizing process is performed, so that the internal stress, produced at the time of execution of the sizing, is released by performing the toughness stabilizing process. For example, the flower blooming of a flanged internal gear is suppressed, and therefore, the dimensional accuracy can be enhanced.

In addition, sizing may be performed after the aforementioned toughness stabilizing process. In this case, sizing is performed after the toughness stabilizing process. Therefore, for instance, compared with the case where sizing is performed before the toughness stabilizing process, a degreasing step can be reduced by once because there is no need to degrease the oil adhering to the internal gear when sizing is performed.

Furthermore, in the aforementioned manufacturing method, the raised temperature may be a temperature where a temperature in a predetermined range is added to a temperature under an operating environmental condition. In this case, the raised temperature is a temperature where a temperature in a predetermined range is added to a temperature under an operating environmental condition. Therefore, even if the temperature under an operating environment rises, there will be no possibility that the toughness of the sintered alloy will be weakened.

Moreover, the raised temperature may be a temperature lower by a temperature in a predetermined range than the brittle point of the sintered metallic alloy. In this case, since the raised temperature is a temperature lower by a temperature in a predetermined range than the brittle point of the sintered metallic alloy, the brashiness is increased by the toughness stabilizing process, and the toughness can be enhanced.

BRIEF DESCRIPTION OF THE DRAWINGS

The file of this patent contains at least one drawing excuted in color. Copies of this patent with color drawing(s) will be provided by the Patent and Trademark Office upon request and payment of the necessary fee.

The above and other objects, features and advantages of the present invention will become more apparent from the following description taken in connection with the accompanying drawings, in which:

FIG. 13 is a table showing measurements of the internal gear shown in FIG. 3 and FIG. 4.

DETAILED DESCRIPTION OF THE PREFERRED EMBODIMENTS

Figure 1:
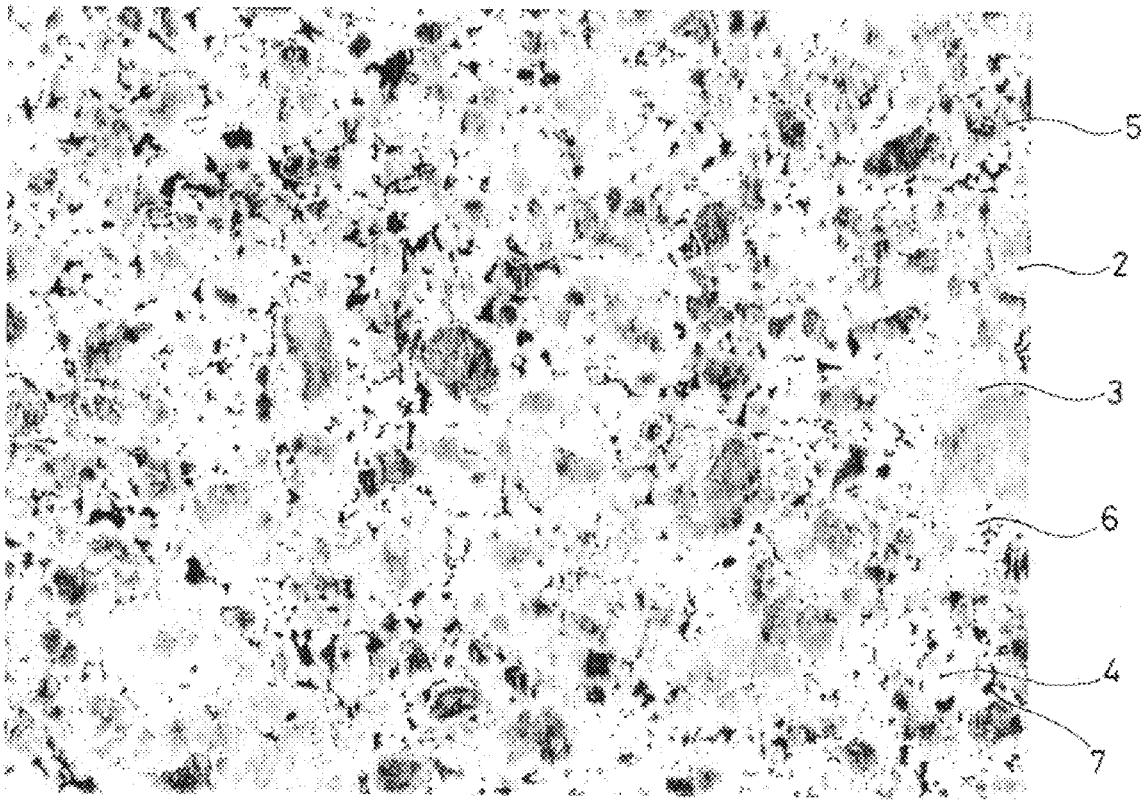
FIG. 1 is a photograph used to explain the structure of a sintered metallic alloy of a first embodiment of the present invention.

A first embodiment of the present invention will hereinafter be described in reference to the drawings. For the same parts as the aforementioned prior art or corresponding parts, a description thereof will be made with the same reference numerals.

FIGS. 1 through 9 and FIGS. 10(*a*) through 10(*h*) show a sintered metallic alloy of the first embodiment of this invention, a manufacturing method for the sintered metallic alloy, and a sintered alloy gear employing the sintered metallic alloy.

First, in the sintered metallic alloy of the first embodiment, the manufacturing method for the sintered metallic alloy, and an internal gear 1 as the sintered alloy gear employing the sintered metallic alloy, a sintered metallic alloy is used in which structures with high toughness structure are distributed approximately uniformly from the surface toward the interior.

Figure 3:
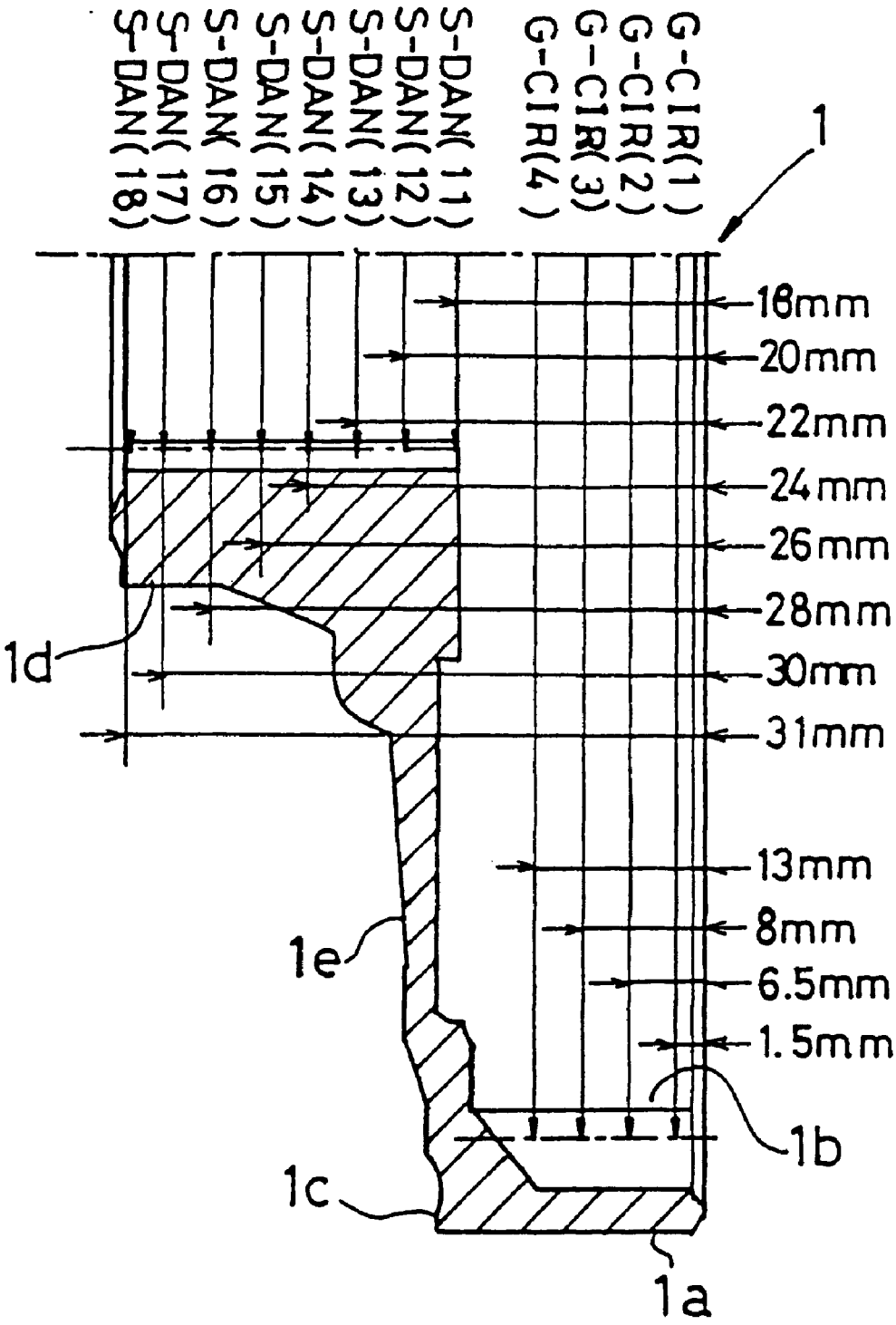
FIG. 3 is a sectional view along a center line of rotation of an internal gear as a sintered alloy gear employing the sintered metallic alloy of the first embodiment.
Figure 4:
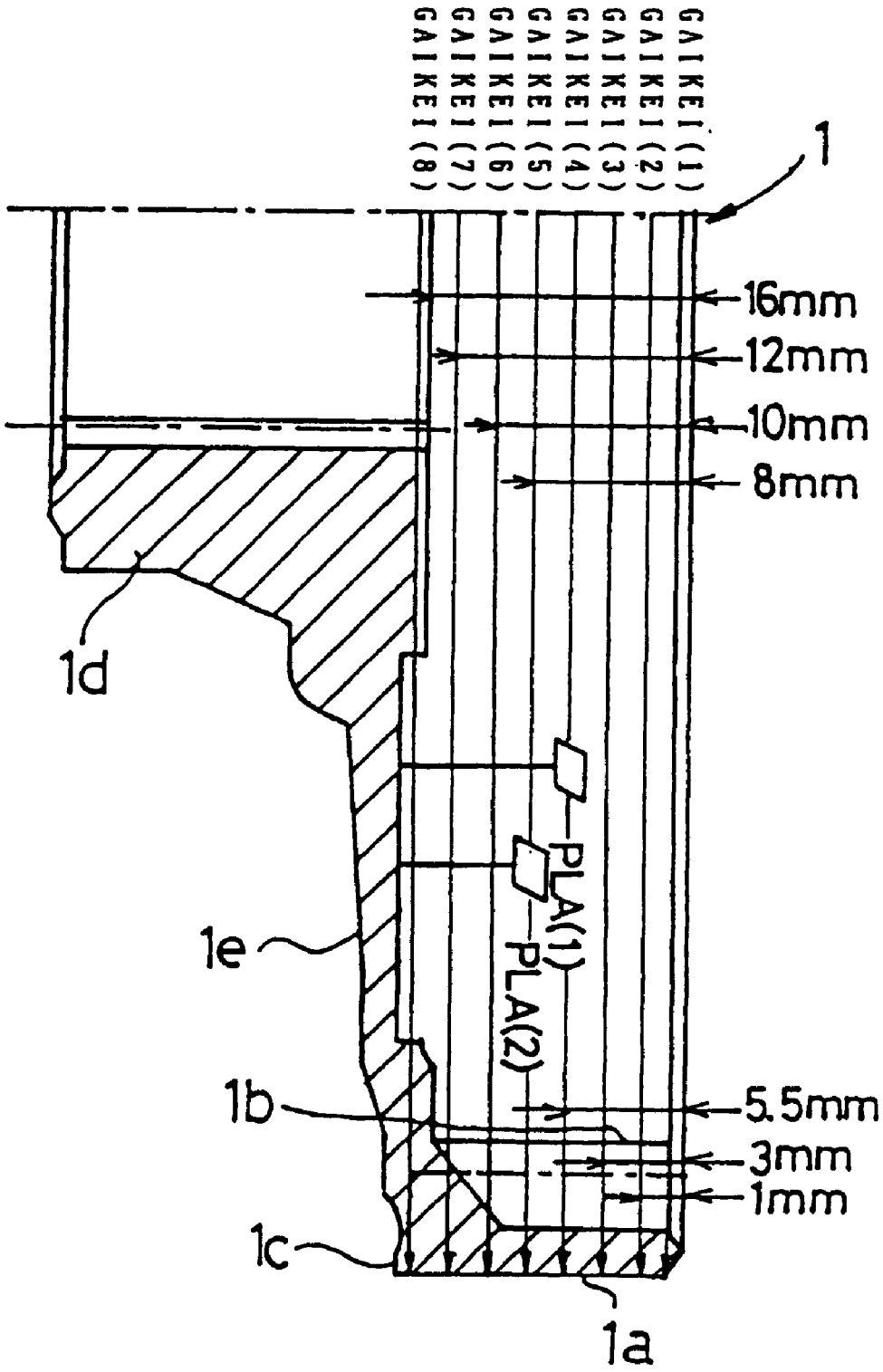
FIG. 4 is a sectional view of the internal gear shown in FIG. 3 measured differently from the measurements of FIG. 3.

As shown in FIG. 3 or 4, the internal gear 1 is chiefly constituted by an internal gear main body 1*a* and a generally disc-shaped flange portion 1*e* formed integrally on one end surface 1*c* of the internal gear main body 1*a*. The internal gear main body 1*a* forms a general ring shape and comprises a gear surface 1*b* at an inner surface portion. The flange portion 1*e* is provided with a boss portion 1*d* at the approximate center thereof.

The constituent parts of this internal gear 1 are 4 wt % nickel, 1.5 wt % copper, 0.5 wt % molybdenum, 0.5 to 0.8 wt % carbon with iron as a main constituent part. By mixing and sintering these raw materials, they are diffusedly bonded, whereby a predetermined configuration is obtained.

The detailed structure of this internal gear 1 will be described in reference to FIGS. 1 and 2.

Figure 2:
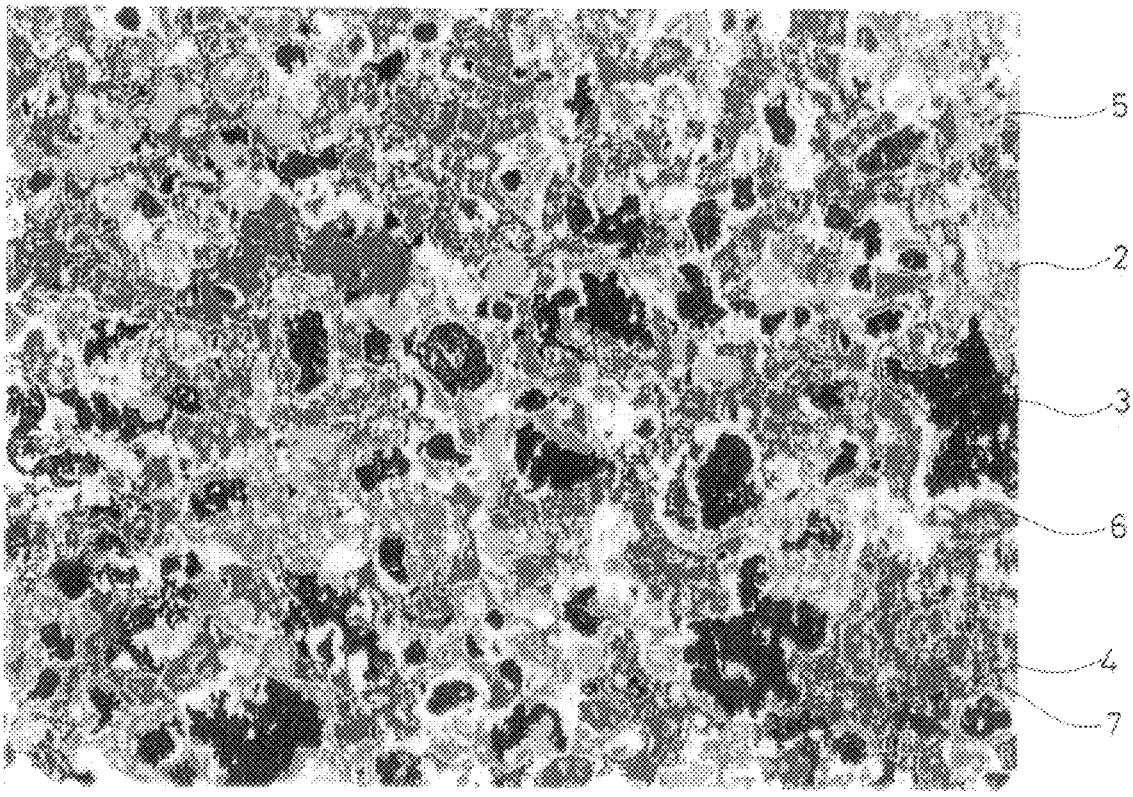
FIG. 2 is a photograph used to explain the structure of the sintered metallic alloy of the first embodiment, each structure portion being color-coded.

In FIG. 2, [the] sky blue colored portions represent ferritic structure portions 2; the royal purple colored portions represent pearlitic structure portions 3; the red colored portions represent martensitic structure portions 4; the yellow colored portions represent bainitic structure portions 5; the green colored portions represent high-alloy portions 6. In general, the ferritic structure portions 2 and the pearlitic structure portions 3 have relatively low hardnesses and form the base portion of the alloy. The hardness increases in order of martensitic structure portion 4, bainitic structure portion 5, and high-alloy portion 6. Note that the black point portions denote pores 7.

Next, the manufacturing method for this internal gear 1 will be described along manufacturing steps, and the operations of the sintered metallic alloy of the first embodiment, the manufacturing method for the sintered metallic alloy, and the sintered alloy gear employing the sintered metallic alloy will be described in detail.

Figures 10A, 10B, 10C:
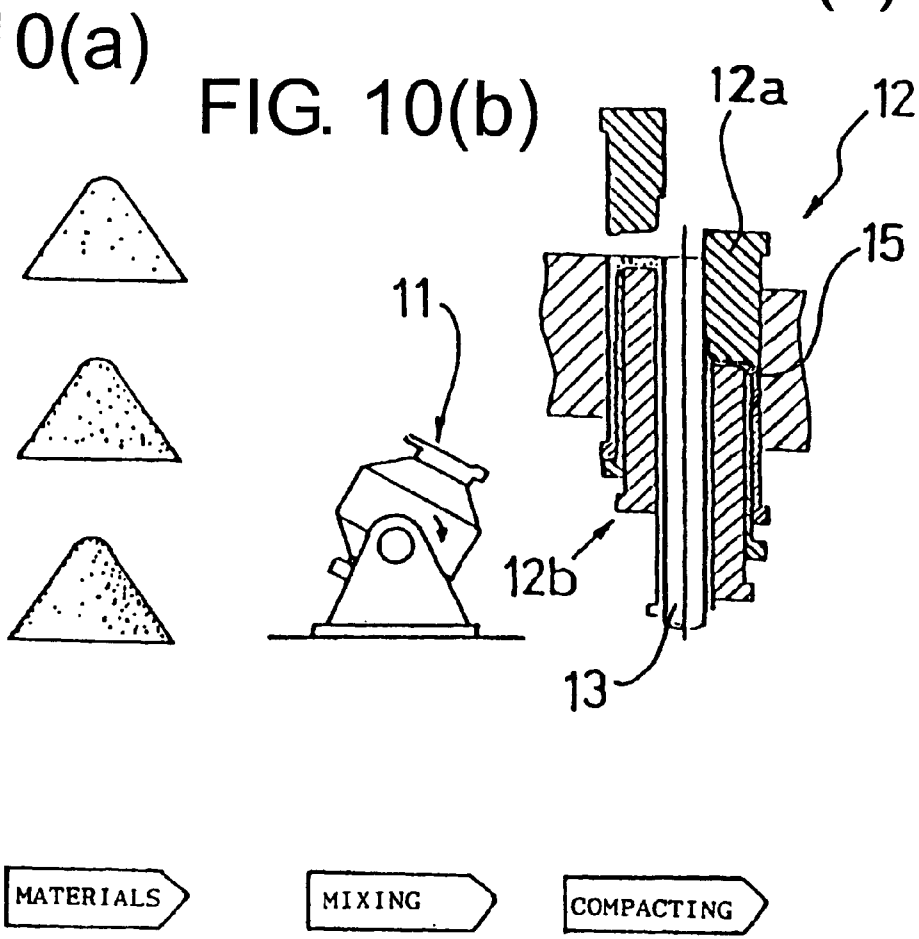
FIGS. 10(*a*) through 10(*h*) illustrate how the sintered metallic alloy of the first embodiment is manufactured.
Figures 10D, 10E, 10F, 10G, 10H:
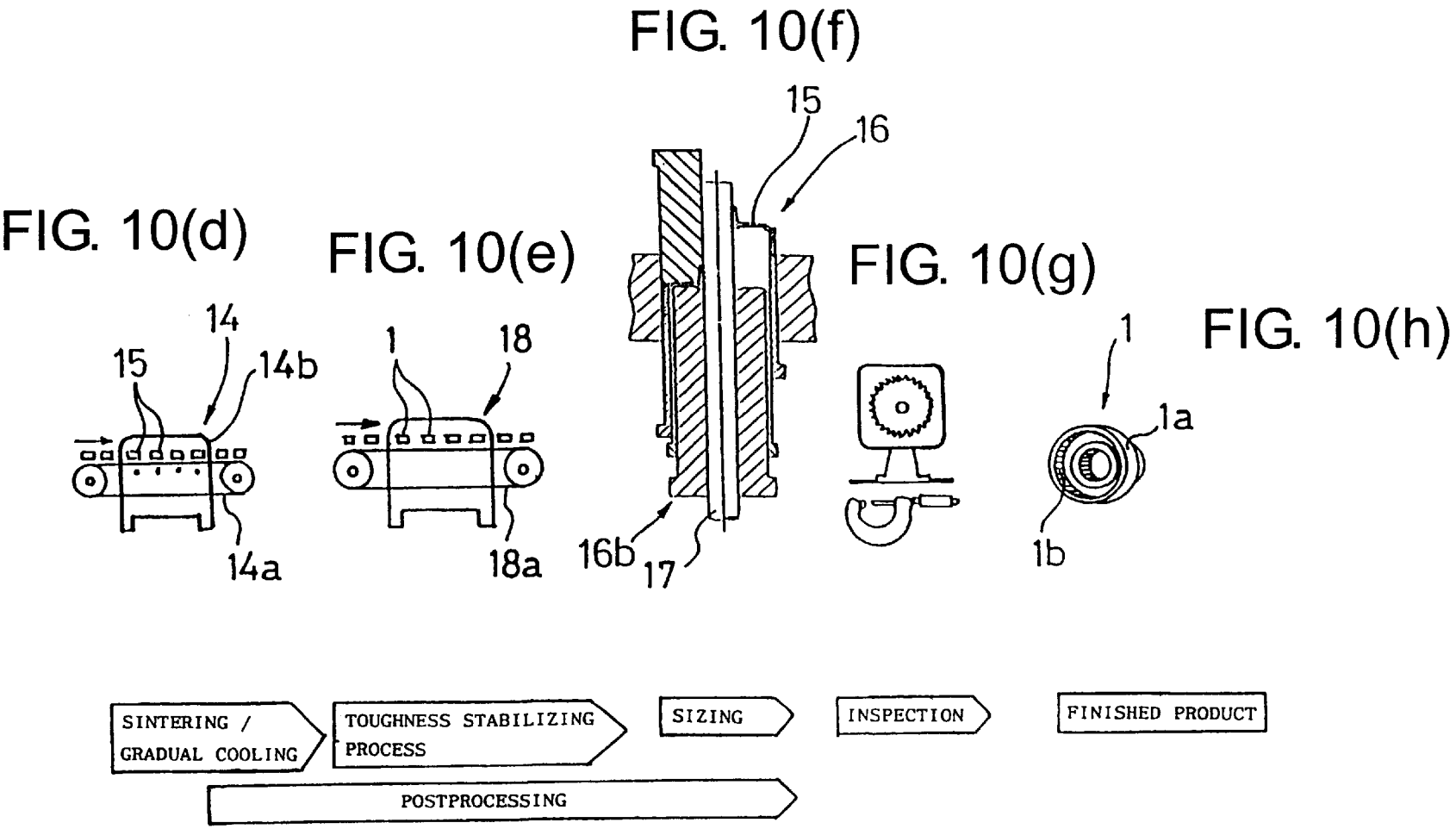

For the internal gear 1, metallic materials (iron powder, any other metal powder, and a lubricating agent), such as those shown in FIG. 10(*a*), are combined and mixed at a predetermined ratio by a mixer 11, as shown in FIG. 10(*b*). As shown in FIG. 10(*c*), a predetermined weight of the mixed metallic materials is poured into a metal mold 12. Then, the upper punch 12*a* and the lower punch 12*b* of the metal mold 12 are moved toward each other along the core rod 13 to apply a pressure of 3 to 7 tonf/cm$^2$ from directions above and below, whereby compression molding is performed and a compressed compact 15 is obtained. Next, as shown in FIG. 10(*d*), the compressed compact 15 is heated in a sintering furnace 14 at a high temperature less than the melting point for a predetermined time, whereby metal particles are diffusedly bonded and solidified.

In the first embodiment, the temperature within the sintering furnace 14 is about 1000+α° C. By dropping the moving speed of a belt conveyor 14*a* being passed through the sintering furnace 14 to 4/7 to ½ of the normal moving speed and also lengthening the time during which the belt conveyor 14*a* stays near the exit 14*b*the solidified compact 15 is gradually cooled and a semi-finished internal gear 1 is obtained.

In the first embodiment, the range of the room temperature is 0° C. to 50° C., and the state cooled to approximately an ambient atmosphere of room temperature is intended to mean the state in which the temperature near the center of the solidified compact 15 in the direction of wall thickness has been reduced to about 50° C. or less.

Next, in the first embodiment, after-treatment is performed in order to further enhance the quality and characteristics and obtain finished products corresponding to various purposes or uses. That is, as shown in FIG. 10(*e*), the aforementioned gradually cooled internal gear 1 is conveyed into and out of a low-temperature furnace 18 by a belt conveyor 18*a*. This low-temperature furnace 18 has been heated to about 200±5° C.

This temperature that is raised is set as a temperature where a safety coefficient temperature of about 20° C. in a predetermined range is added to about 180° C., by considering the fact that the highest temperature of the internal gear 1 used in a planetary gear apparatus such as an automatic transmission reaches about 180° C. under an operating environmental condition.

Also, the temperature that is raised in this toughness stabilizing process is set to a temperature lower by a predetermined range of about 50 to 100° C. than about 250 to 300° C. which is the brittle point of a sintered metallic alloy.

The conveyed internal gear 1 is raised in temperature, and the toughness stabilizing process is performed. To promote an approximately uniform distribution of structures having high toughness, the center portion of the internal gear 1 in the direction of wall thickness is raised near the temperature of about 200° C. within the furnace and held for a predetermined time at the approximate same temperature as the exterior surface.

In this first embodiment, the moving speed of the belt conveyor 18*a* which is passed through the aforementioned low-temperature furnace 18 is set so that the center portion of the internal gear 1 in the direction of wall thickness is held for a predetermined time at the approximate same temperature as the exterior surface.

Figure 5:
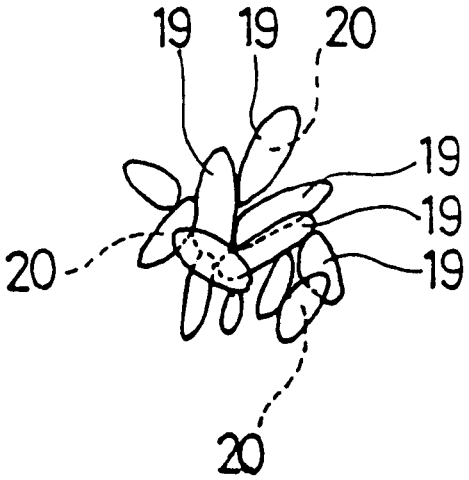
FIG. 5 is an enlarged schematic diagram used to explain the inner structure of the sintered metallic alloy of the first embodiment, the structure after sintering and before the toughness stabilizing process being shown.
Figure 6:
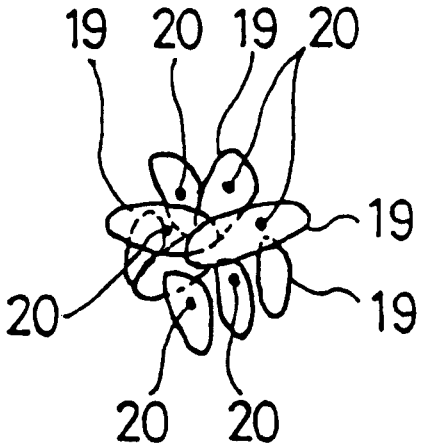
FIG. 6 is an enlarged schematic diagram used to explain the inner structure of the sintered metallic alloy of the first embodiment, the structure after the toughness stabilizing process being shown.

At this time, as shown in FIG. 5, it is believed that in the diffusedly bonded state after sintering, a primary martensitic state is obtained in which carbides 20 enter and dissolve into iron solid solutions 19. As shown in FIG. 6, it is also believed that after the toughness stabilizing process, a secondary martensitic state is obtained in which carbides 20 are separated out from the iron solid solutions 19.

Figure 7:
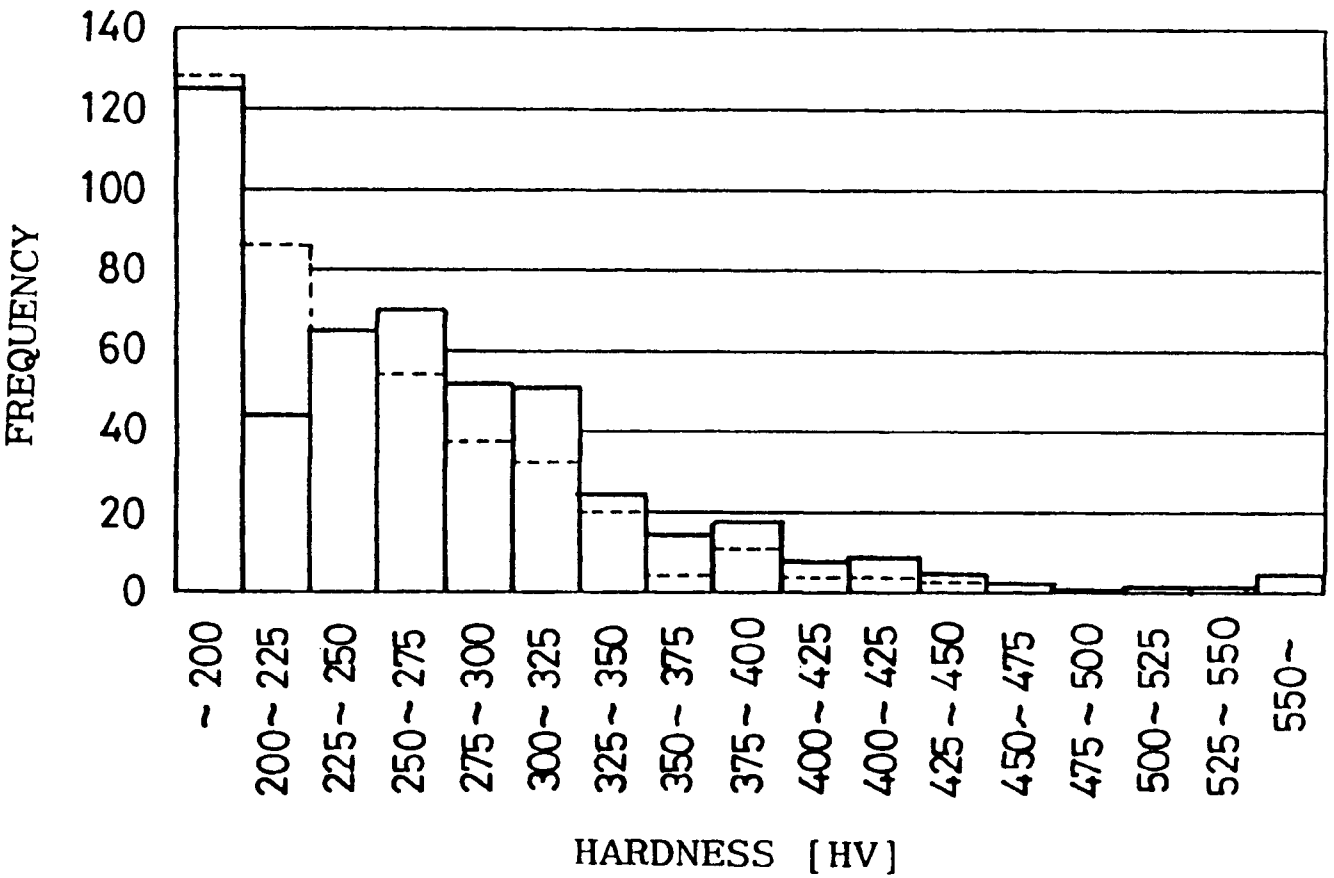
FIG. 7 is a graph showing the results of a full automatic Vickers matrix test performed on the sintered metallic alloy of the first embodiment.

For this reason, as shown in FIG. 7, the high-hardness portion and the low-hardness portion, described by a dotted line representing the state after the end of sintering with a Vickers hardness measuring method, are drifted to approximately the center of the solid-line portion representing the state after the end of a toughness stabilizing process, whereby the distribution density of the medium-hardness portions is increased.

The measured values in FIG. 7 were obtained by a full automatic Vickers matrix hardness test. The test was performed with 500 test points, a test load of 50 gf, a holding time of 15 sec, and a point-to-point distance of 50 ηm. As a result, a minimum hardness value of 9.3 HV, a maximum hardness value of 644.0 HV, a mean hardness value of 255.3, and a standard deviation of 107.69 were obtained.

Figure 8:
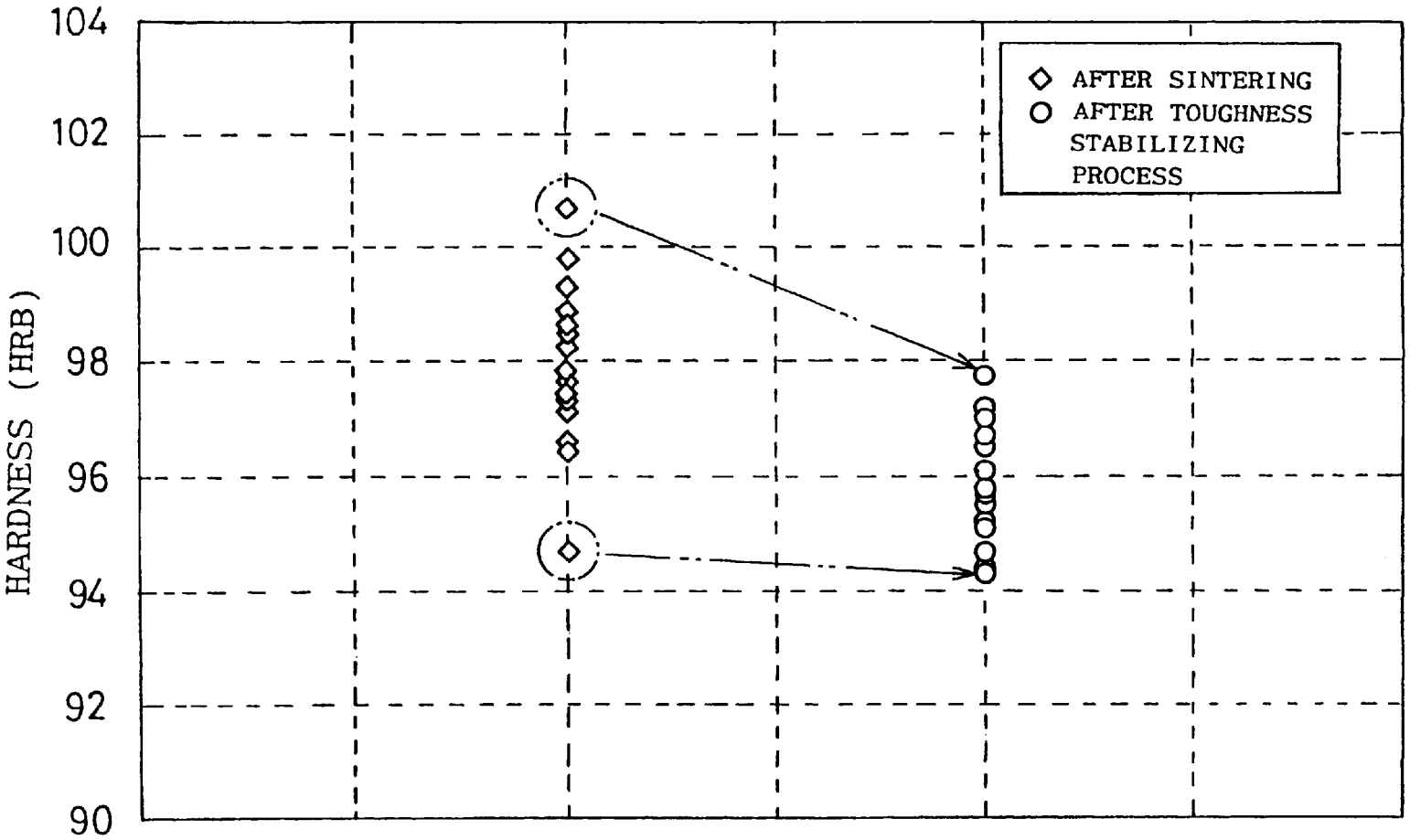
FIG. 8 is a graph showing the results of a Rockwell test performed on the sintered metallic alloy of the first embodiment.

Similarly, as shown in FIG. 8, the high-hardness portion and the low-hardness portion, described by a set of void squares on the left side of FIG. 8 representing the states after the end of sintering with a Rockwell hardness measuring method, are drifted so that they are described with a set of void circles representing the states after the end of a toughness stabilizing process, whereby the distribution density of the medium-hardness portions is increased. In this case the hardness of the lowest hardness portion remains almost the same.

Figure 9:
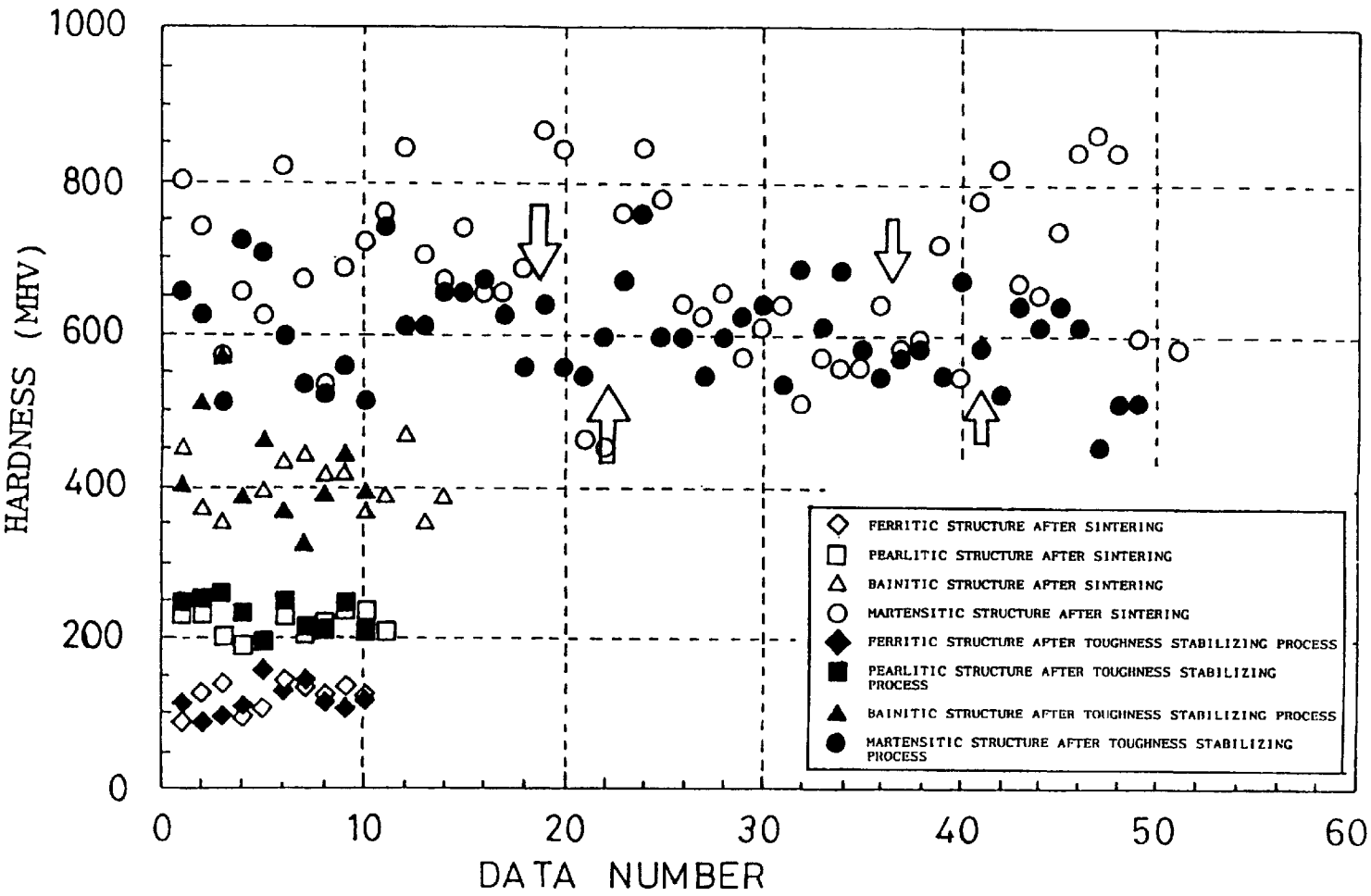
FIG. 9 is a graph showing how the microscopic hardness by structure portions of the sintered metallic alloy of the first embodiment is drifted.

Furthermore, as shown in the microscopic hardness by structures of FIG. 9, the void points representing the states after the end of sintering are drifted toward the medium-hardness portions, as shown by the black points representing the states after a toughness stabilizing process. As a result, the distribution density of the medium-hardness portions is increased. In this case the hardness of the lowest-hardness portion remains almost the same.

For this reason, as shown in FIGS. 1 and 2, the bainitic structure portion 5 and the martensitic structure portion 4, which are the second highest in rigidity behind the high-alloy portion 6, are mainly changed to structures having high toughness in the form enclosing the surroundings as if the ferritic structure portion 2 and the pearlitic structure portion 3 which form the base portion are bridged with the high-alloy portion 6, while holding rigidity. As a result, the high-toughness structures within the sintered metallic alloy are distributed approximately uniformly in the form of a surface.

Therefore, structure portions having rigidity approximately uniformly are distributed within the internal gear 1 and the surface portion is also bonded in the form of a surface, whereby the toughness is enhanced.

Next, as shown in FIG. 10(*f*), in this sintered internal gear 1, the solidified compact 15 is put into a sizing metal mold 16. The upper punch 16*a* and the lower punch 16*b* of this sizing metal mold 16 are moved toward each other along the core rod 17 to apply pressure to the solidified compact 15 again from directions above and below, whereby sizing is performed.

After sizing, inspection is performed as shown in FIG. 10(*g*), and the sintered internal gear 1 is obtained as the finished product (FIG. 10(*h*)).

In the internal gear 1 formed in the aforementioned manner, structure portions having different values of rigidity are distributed approximately uniformly without separation of layers different in rigidity, whereby stress, applied in the form of a point, is also supported by the entire surface.

For this reason, there is no possibility that a portion of the internal gear 1 will cave in due to concentration of stress, and the stress between members with a small contacting area can be supported.

For instance, in the internal gear 1 of the first embodiment, even if the stress of a pinion were concentrated on the small area of the gear surface 1*b*, the gear surface 1*b* will not cave in because it has high toughness in the form of a surface from the exterior surface layer to the inner layer. Thus, the internal gear 1 has favorable durability.

In addition, in the first embodiment, even if the generally disk-shaped flange 1*e* forming its boss portion 1*d* at the approximate center thereof is formed integrally on one end face 1*c* of the internal gear main body 1*a* having a general ring shape and forming its gear surface 1*b* at an interior surface portion and also has a configuration which easily causes flower blooming, stress due to molding can be reduced and flower blooming after cooling can be suppressed, because structure portions having different values of rigidity are distributed approximately uniformly without separation of layers different in rigidity. For this reason, dimensional accuracy can be enhanced.

The distance from the rotational center line of the main body 1*a* of the internal gear 1 shown in FIGS. 3 and 4 to the pitch line, the size of the outside diameter, the flatness of the B-surface which is a thrust-bearing receiving portion, and the distance from the rotational center line of the spline portion formed in the inner circumference of the boss portion 1*d* to the pitch line, as shown in Table 1 of FIG. 13, are listed as initial measured values A after the end of sintering, and measurements are also performed at the same sites after the toughness stabilizing process and the results are listed as measured values B. The difference C indicates a difference between the measured value B and the measured value A and represents the configuration deformed by the toughness stabilizing process.

As evident in Table 1 of FIG. 13, the opening end of the internal gear main body 1*a* and the spline portion in the inner circumference of the boss portion 1*d* are widened by molding and sintering; however, the internal gear 1, deformed in the form of flower blooming, is again contracted by the toughness stabilizing process, whereby the flower blooming is alleviated.

Also, in the first embodiment, the internal gear 1 is heated within the low-temperature furnace 18, whereby the internal stress, produced during powder compression molding, is released. Therefore, compared with casted or forged products, the internal stress in the sintered alloy gear with less internal stress can be further reduced.

In addition, in the first embodiment, sizing is performed after the aforementioned toughness stabilizing process. Therefore, compared with the case where sizing is performed before the toughness stabilizing process, a degreasing step can be reduced once because there is no need to degrease the oil adhering to the internal gear 1 when sizing is performed.

Furthermore, in the first embodiment, the temperature that is raised in the toughness stabilizing process is a temperature of about 200° C. where temperature 20° C. in a predetermined range is added to a temperature of 180° C. under an operating environmental condition. Therefore, even if the temperature under an operating environment rises to about 180° C., there will be no possibility that the toughness of the internal gear 1 will be weakened.

Moreover, in the first embodiment, the temperature that is raised in the toughness stabilizing process is set to a temperature lower by a predetermined range of about 50 to 100° C. than about 250 to 300° C. which is the brittle point of a sintered metallic alloy. For this reason, in corporation with gradual cooling after sintering, the brashiness is increased by the toughness stabilizing process, so that the toughness can be enhanced.

Figures 11A, 11B, 11C:
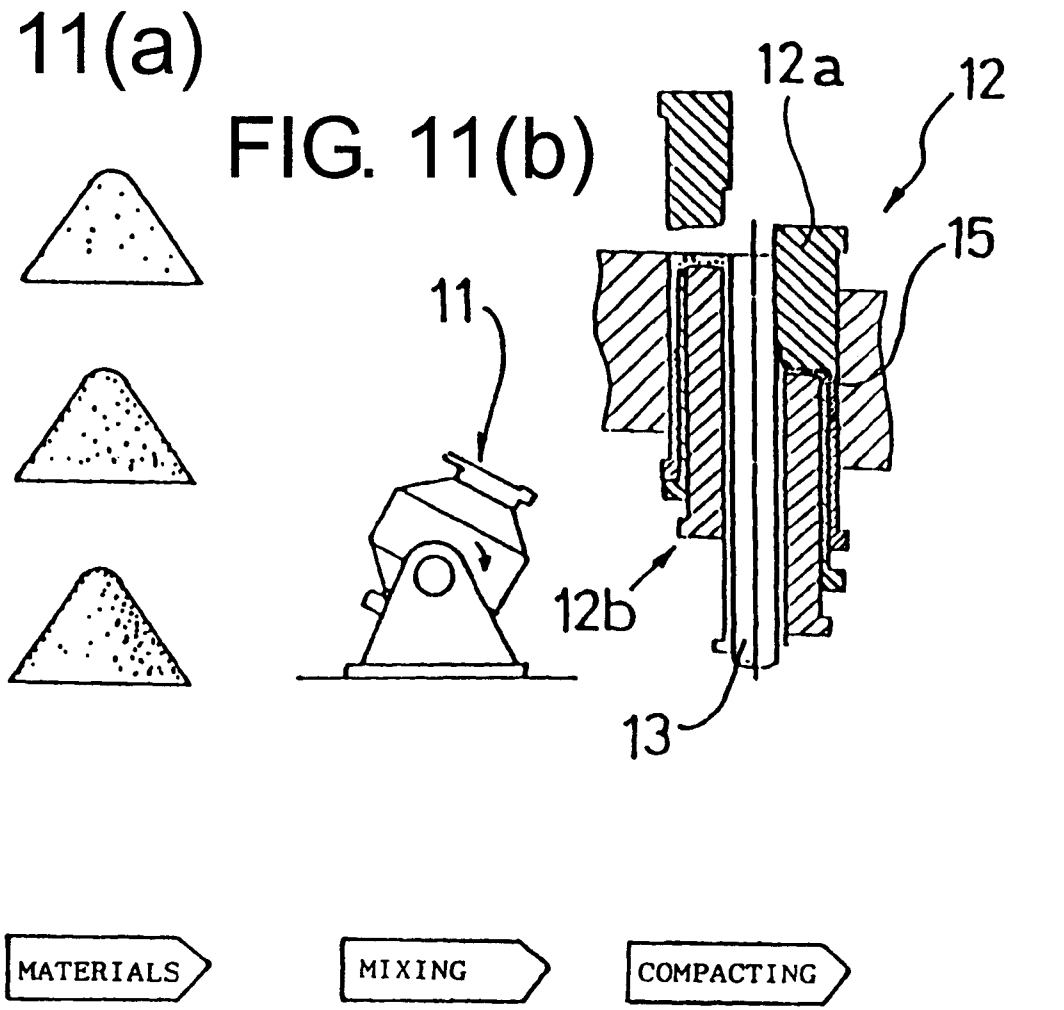
FIGS. 11 (*a*) through 11(*h*) illustrate how a sintered metallic alloy according to a second embodiment of the present invention is manufactured.
Figures 11D, 11E, 11F, 11G, 11H:
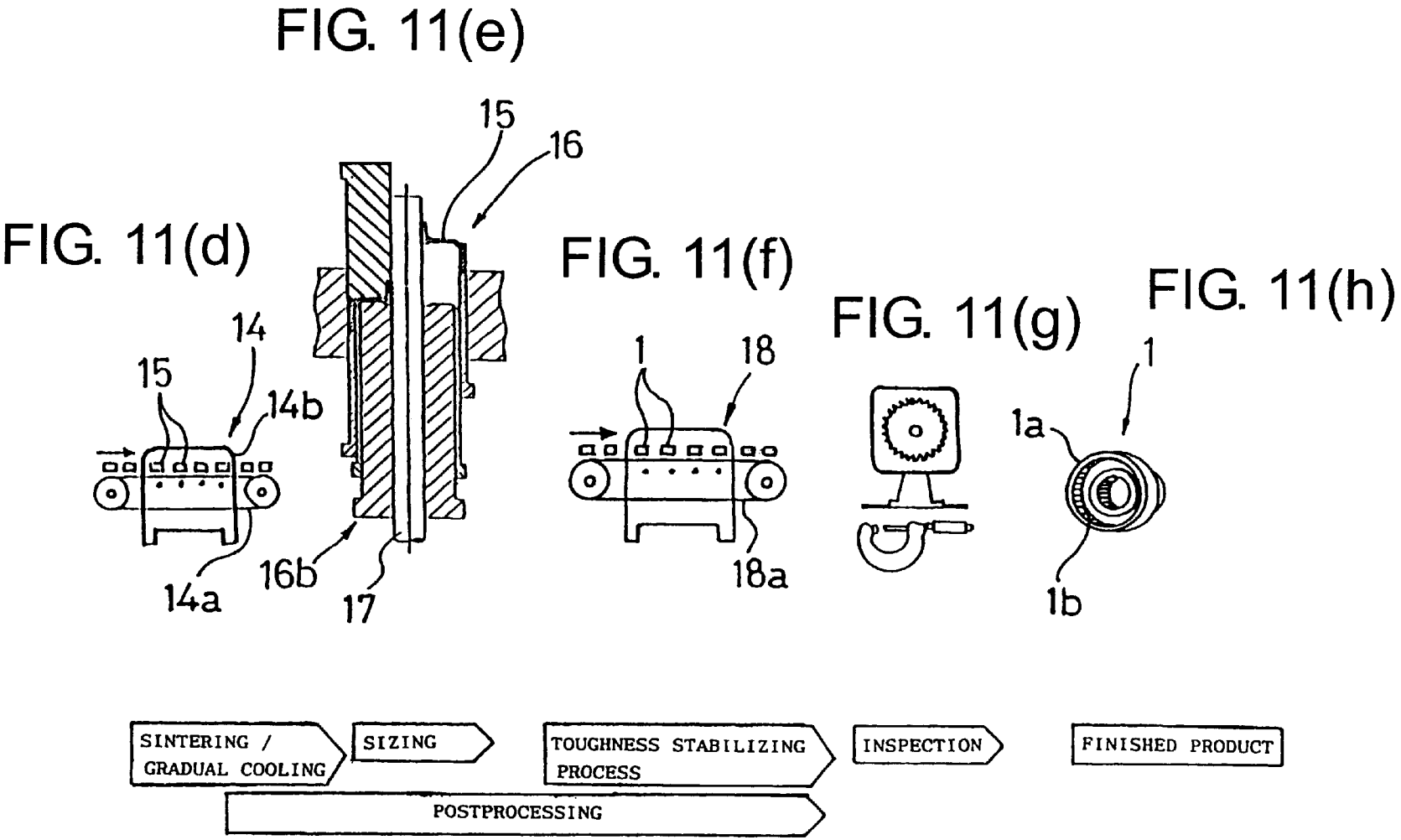
Figures 12A, 12B, 12C, 12D:
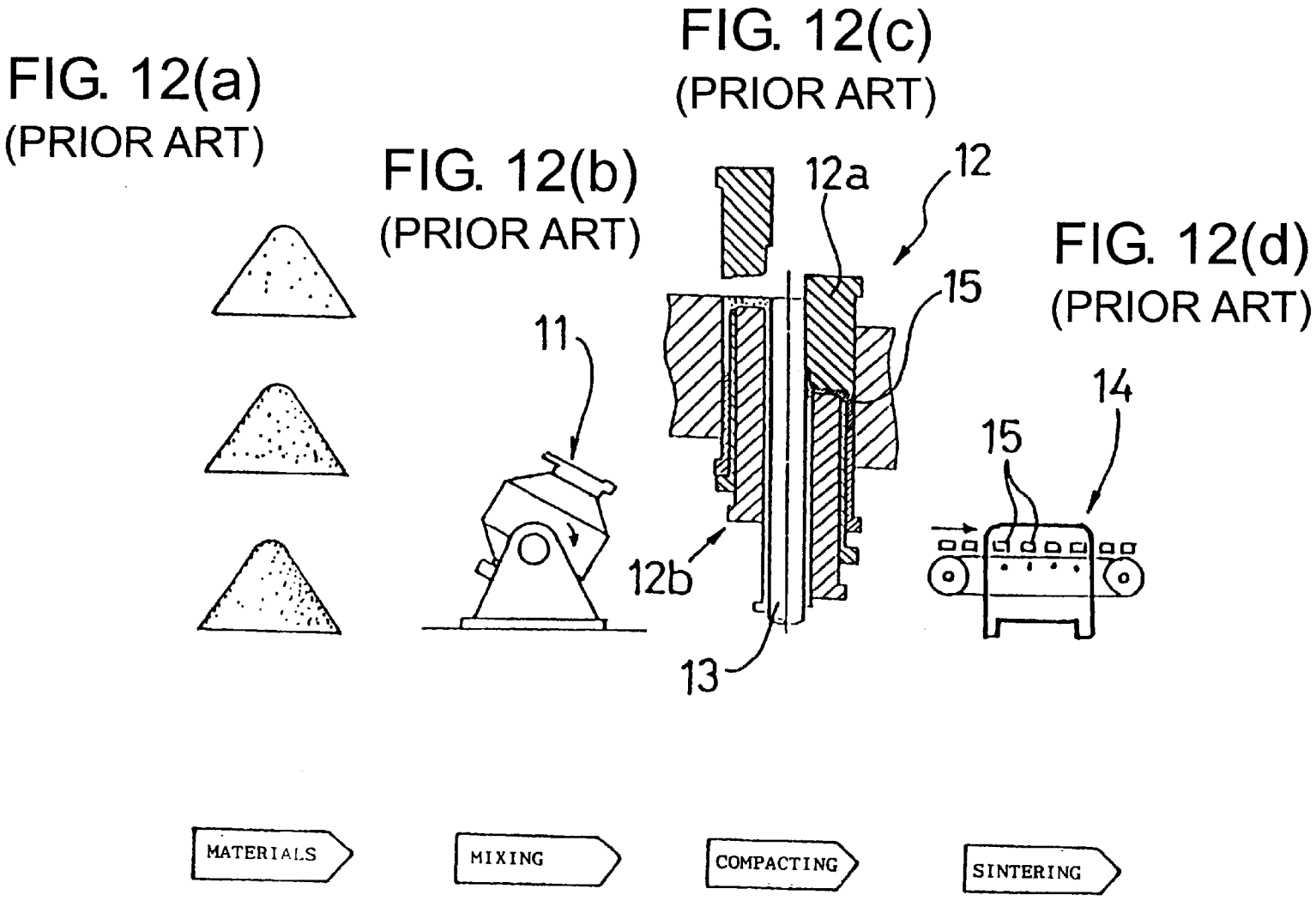
FIG. 12(a) (PRIOR ART)
FIG. 12(b) (PRIOR ART)
FIG. 12(c) (PRIOR ART)
FIG. 12(d) (PRIOR ART)
FIGS. 12(*a*) through 12(*g*) illustrate how a conventional sintered metallic alloy is manufactured.
Figures 12E, 12F, 12G:
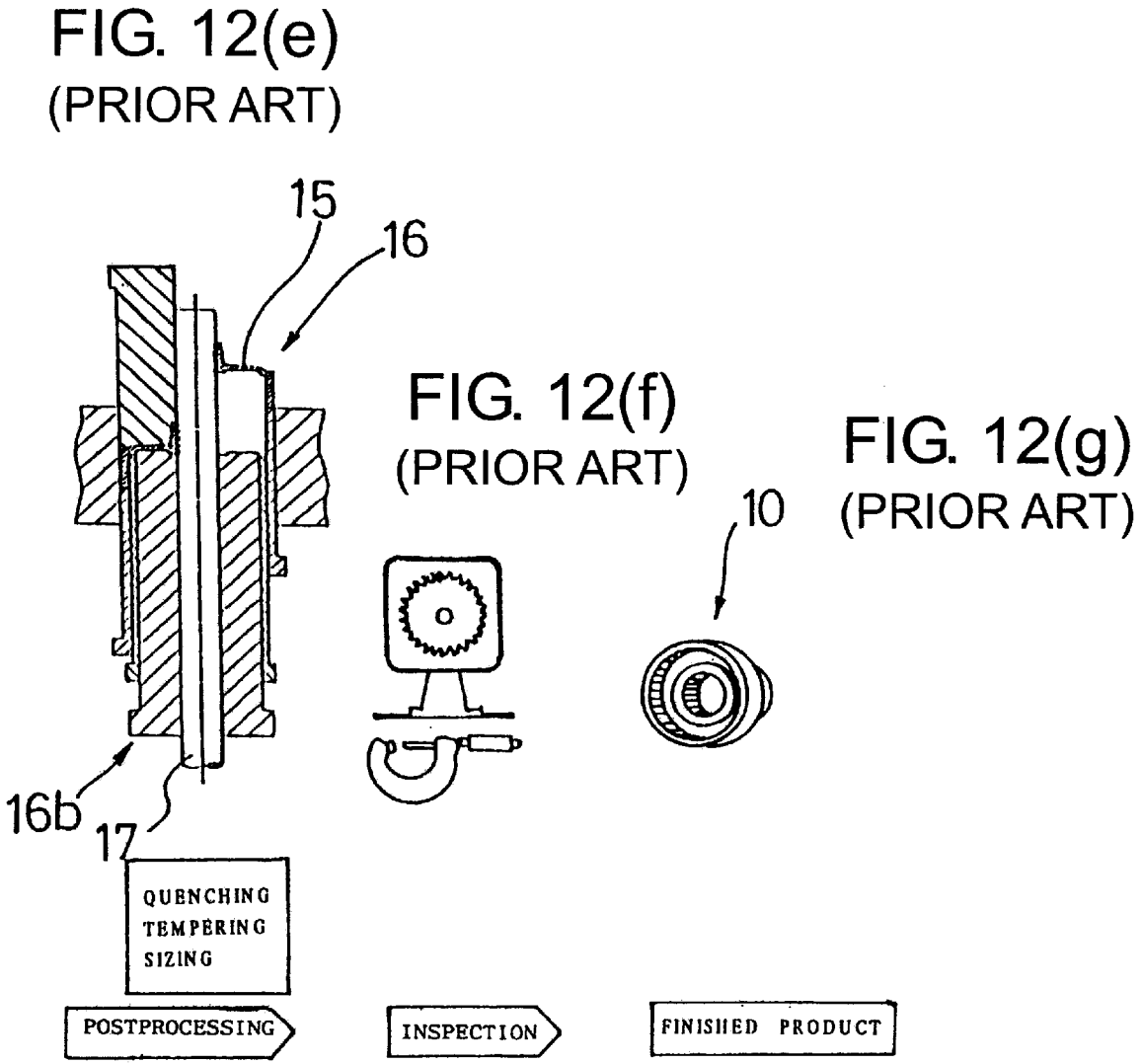
FIG. 12(e) (PRIOR ART)
FIG. 12(f) (PRIOR ART)
FIG. 12(g) (PRIOR ART)

FIGS. 11(*a*) through 11(*h*) illustrate a sintered metallic alloy of a second embodiment of this invention, a manufacturing method for the sintered metallic alloy, and a sintered alloy gear employing the sintered metallic alloy. Note that for the same parts as the aforementioned first embodiment or corresponding parts, a description thereof will be made with the same reference numerals.

The second embodiment is constructed so that sizing is performed by a sizing metal mold 16 before the aforementioned toughness stabilizing process is performed in a low-temperature furnace 18.

Next, the operations of the sintered metallic alloy of the second embodiment, the manufacturing method for the sintered metallic alloy, and the sintered alloy gear employing the sintered metallic alloy will be described.

In the second embodiment constructed as described above, sizing is performed before the aforementioned toughness stabilizing process is performed, so that the stress produced during sizing is released by performing the toughness stabilizing process. For example, the flower blooming of a flanged internal gear is further suppressed, so that the dimensional accuracy can be further enhanced.

Since the remaining constitution, operation, and advantages are substantially similar to those of the aforementioned first embodiment, a description thereof will not be given.

While the present invention has been described with reference to the first and second embodiments, the invention is not to be limited to the details given herein, but may be modified within the scope of the appended claims. For example, in the first and second embodiments, although the sizing by the sizing metal mold 16 is performed before and after the toughness stabilizing process, the present invention is not particularly limited to this. For example, sizing need not be performed. In addition, in the first embodiment, although the carbon quantity within the sintered alloy preferably is 0.6 wt %, the present invention is not particularly limited to this. For example, it may be any quantity between about 0.5 wt % and 0.8 wt % as long as it is within a range that can achieve an enhancement in the toughness of a sintered metallic alloy that is the object of the present invention.

What is claimed is:

1. A method of manufacturing a sintered metallic alloy, comprising the steps of:

sintering metallic materials formed in a predetermined shape in a sintering furnace to make a sintered metallic alloy, said materials being powdered materials that become the sintered alloy including ferrite and pearlite as major constituents after said sintering;

cooling the sintered metallic alloy gradually to an ambient atmosphere of room temperature; and raising temperature of the cooled sintered metallic alloy up to a temperature lower than a brittle point by 50–100° C. and performing a toughness stabilizing process on the sintered metallic alloy so that structure portions with high toughness are distributed approximately uniformly.

2. The method as set forth in claim 1, wherein sizing is performed before said toughness stabilizing process is performed.

3. The method as set forth in claim 1, wherein sizing is performed after said toughness stabilizing process.

4. The method as set forth in claim 1, wherein the raised temperature is a temperature where a temperature in a predetermined range is added to a temperature under an operating environmental condition.

5. The method as set forth in claim 1, wherein the raised temperature is a temperature lower by a temperature in a predetermined range than the brittle point of said sintered metallic alloy.

6. A method of manufacturing a sintered metallic alloy, comprising the steps of:

sintering metallic materials formed in a predetermined shape in a sintering furnace to make a sintered metallic alloy;

cooling the sintered metallic alloy gradually to an ambient atmosphere of room temperature;

performing sizing of the cooled metallic alloy; and raising temperature of the cooled sintered metallic alloy and performing a toughness stabilizing process on the sintered metallic alloy so that structure portions with high toughness are distributed approximately uniformly.

7. The method as set forth in claim 6, wherein the raised temperature is a temperature where a temperature in a predetermined range is added to a temperature under an operating environmental condition.

8. The method as set forth in claim 6, wherein the raised temperature is a temperature lower by a temperature in a predetermined range than a brittle point of said sintered metallic alloy.

9. A method of manufacturing a sintered metallic alloy, comprising the steps of:

sintering metallic materials formed in a predetermined shape in a sintering furnace to make a sintered metallic alloy;

cooling the sintered metallic alloy gradually to an ambient atmosphere of room temperature;

raising temperature of the cooled sintered metallic alloy and performing a toughness stabilizing process on the sintered metallic alloy so that structure portions with high toughness are distributed approximately uniformly; and performing sizing of the stabilized metallic alloy.

10. The method as set forth in claim 9, wherein the raised temperature is a temperature where a temperature in a predetermined range is added to a temperature under an operating environmental condition.

11. The method as set forth in claim 9, wherein the raised temperature is a temperature lower by a temperature in a predetermined range than a brittle point of said sintered metallic alloy.

* * * * *